US012313268B2

(12) United States Patent
Teboulle et al.

(10) Patent No.: US 12,313,268 B2
(45) Date of Patent: May 27, 2025

(54) METHOD FOR CONTROLLING A DISTRIBUTION OF DOMESTIC HOT WATER, ASSOCIATED SUPPLY SYSTEM AND DISTRIBUTION METER

(71) Applicant: SAGEMCOM ENERGY & TELECOM SAS, Rueil Malmaison (FR)

(72) Inventors: Henri Teboulle, Rueil Malmaison (FR); Patrick Cazein, Rueil Malmaison (FR)

(73) Assignee: SAGEMCOM ENERGY & TELECOM SAS, Bois-Colombes (FR)

( * ) Notice: Subject to any disclaimer, the term of this patent is extended or adjusted under 35 U.S.C. 154(b) by 411 days.

(21) Appl. No.: 17/677,500

(22) Filed: Feb. 22, 2022

(65) Prior Publication Data

US 2022/0268451 A1 Aug. 25, 2022

(30) Foreign Application Priority Data

Feb. 22, 2021 (FR) ..... 2101697

(51) Int. Cl.
*F24D 19/10* (2006.01)
*F24H 15/148* (2022.01)
(Continued)

(52) U.S. Cl.
CPC ..... *F24D 19/1063* (2013.01); *F24H 15/148* (2022.01); *F24H 15/265* (2022.01); *F24H 15/269* (2022.01); *F24D 2220/042* (2013.01)

(58) Field of Classification Search
CPC ..... F24D 19/1063; F24D 2220/042; F24D 17/0073; F24D 19/1051; F24H 15/148;
(Continued)

(56) References Cited

U.S. PATENT DOCUMENTS 5,337,955 A * 8/1994 Burd ..... F24D 19/1009 236/91 B
7,920,983 B1 * 4/2011 Peleg ..... G06Q 10/06 702/50
(Continued)

FOREIGN PATENT DOCUMENTS

EP 3 098 536 A1 11/2016
FR 2 936 042 A1 3/2010
(Continued)

OTHER PUBLICATIONS

Lévesque et al. (Residential water heater temperature: 49 or 60 degrees Celsius?) 2004, p. 11-12. (Year: 2004).*
(Continued)

*Primary Examiner* — Kidest Bahta
(74) *Attorney, Agent, or Firm* — Williams Mullen; R. Brian Drozd

(57) ABSTRACT

A method for controlling a distribution temperature of domestic hot water implemented in a management unit of an installation for producing domestic hot water and including steps for obtaining mean temperatures of the distributed hot water, determined by time ranges and measured by one or more divisional distribution meters in the course of a reference period; obtaining a minimum value and a maximum value of these temperature averages in order to determine a temperature condition of the distributed hot water from at least the maximum value or the minimum value, and from at least one predefined temperature threshold, and, if the distribution condition determined is met, sending a sequence controlling the production temperature to the production installation. Also, a distribution installation, a distribution meter and a unit for managing the distribution of domestic hot water.

13 Claims, 7 Drawing Sheets

(51) Int. Cl.
*F24H 15/265* (2022.01)
*F24H 15/269* (2022.01)

(58) Field of Classification Search
CPC ..... F24H 15/265; F24H 15/269; E03C 1/02; G06F 17/18; G06Q 10/0635
See application file for complete search history.

(56) References Cited

U.S. PATENT DOCUMENTS

| | | | | |
|---|---|---|---|---|
| 2022/0196249 | A1* | 6/2022 | Lesage | F24D 17/0073 |
| 2024/0005190 | A1* | 1/2024 | Kong | G06N 5/01 |

FOREIGN PATENT DOCUMENTS

| | | | |
|---|---|---|---|
| FR | 3 046 218 | A1 | 6/2017 |
| WO | 2019/053385 | A1 | 3/2019 |

OTHER PUBLICATIONS

Nov. 11, 2021 Search Report issued in French Patent Application No. 2101697.

* cited by examiner

| | T1 | T2 | T3 | T4 | T5 | T6 | T7 | T8 |
|---|---|---|---|---|---|---|---|---|
| 12 | 48 | 51 | 51 | **51** | 51 | 51 | 51 | 48 |
| 14 | 46 | 49 | 49 | 49 | 49 | 49 | 49 | 46 |
| 16 | 40 | 43 | 43 | 43 | 43 | 43 | 43 | **40** |

T

Fig. 2

METHOD FOR CONTROLLING A DISTRIBUTION OF DOMESTIC HOT WATER, ASSOCIATED SUPPLY SYSTEM AND DISTRIBUTION METER

TECHNICAL FIELD

The present invention relates to the field of the controlled distribution of domestic hot water. The invention relates more particularly to the production of domestic hot water in a collective installation according to the temperature of the water distributed and by means of improved distribution meters.

PRIOR ART

Domestic hot water can be produced individually or collectively. In the case of a collective production, the domestic hot water is produced in a collective production installation and then distributed through a distribution installation (also referred to as a distribution system) to divisional distribution meters. Thus, for example, one and the same boiler can supply domestic hot water to a large number of dwellings through a common distribution installation. Each of the dwellings is then equipped with a consumption meter known as a "divisional meter" that makes it possible to measure and invoice the consumption of hot water particular to this dwelling. Losses of heat in the common distribution installation are unavoidable and the water supplied in a dwelling usually has a temperature substantially lower than that of the water supplied at the outlet of the production boiler. Controlling the production temperature at the distribution boiler does not make it possible, because of the losses of heat, to supply domestic hot water at a controlled temperature to the various distribution points consisting of the divisional distribution meters.

In installations for distributing domestic hot water, the growth of legionella, bacteria naturally present in water, is very rapid when the temperature of the water is between 25° C. and 42° C., with a maximum growth at approximately 37° C. The legionella frequently colonise the installations for distributing domestic hot water and are responsible for respiratory illnesses. Very fortunately, these bacteria cease to multiply below 20° C. and above 46° C. Furthermore, it is known that these bacteria are destroyed in a few hours at a temperature of 55° C. or in 30 minutes at a temperature of 60° C., and almost instantaneously at a temperature of 70° C. Thus temperature ranges for storing and distributing water are to be favoured for limiting the development of these bacteria, which present a risk for health. Moreover, it is known that scale deposits are harmful to the production and distribution installations and that these deposits are promoted by water heated to temperatures above 50° C. Boilers producing domestic hot water make it possible to effect heating at temperatures of between 60° C. and 65° C. to prevent the risks related to the presence of legionella. This does not however allow precise control of the temperature at the various points where the domestic hot water is distributed and taken off in the dwellings.

Finally, when a dwelling has been unoccupied for a long period, for example for several weeks, it is possible that legionella may have developed in the distribution circuit of the dwelling. It is then advisable to quickly eliminate these legionella as soon as the dwelling is once again occupied.

The situation can therefore be improved.

DISCLOSURE OF THE INVENTION

The aim of the invention is to propose a method and a system for distributing domestic hot water making it possible to solve at least some of the drawbacks of the prior art.

For this purpose, a method is proposed for controlling a distribution temperature of domestic hot water, implemented in a unit for managing an installation for producing hot water, and comprising:

- obtaining first information representing mean temperatures of the distributed hot water, determined by time ranges, and measured by one or more divisional distribution meters, during a reference period,
- obtaining a minimum value and a maximum value of this first information,
- determining a temperature condition of the distributed hot water from at least the maximum value or from at least the minimum value, and from at least one predefined temperature threshold, and
- if the condition is met, sending a sequence controlling the distribution temperature to the installation for producing domestic hot water.

Advantageously, it is thus possible to control the production temperature of domestic hot water from temperature information measured as close as possible to the actual take-off points, so as to control the temperature of the water distributed at these take-off points. The control can furthermore be done dynamically and according to predefined criteria, such as a risk of legionnaire's disease or a risk of significant scaling.

The method according to the invention may also comprise the following features, considered alone or in combination:

- The at least one predefined temperature threshold is between 45° C. and 51° C. or equal to one of these values, preferentially between 46° C. and 50° C. or equal to one of these values.
- This advantageously makes it possible to note a high or reduced risk of legionnaire's disease and a high or limited risk of scaling.
- The control sequence is sent to the production installation via one of the divisional water-distribution meters.
- Advantageously, it is thus possible to simplify the organisation of the wireless communications in the installation for distributing domestic hot water.
- The temperature condition of the domestic hot water is determined so that the minimum value of the temperature averages obtained is higher than or equal to a first predefined temperature threshold and the maximum value of the temperature averages obtained is lower than or equal to a second predefined temperature threshold, higher than the first threshold.
- Advantageously, it is possible to note an absence of particular risk with regard to the presence of legionella or scale and to organise a preventive maintenance action against legionella by controlled increase of the production temperature of the water according to a predefined short cycle.
- The temperature condition of the domestic hot water is determined so that the minimum value of the temperature averages obtained is lower than a first predefined temperature threshold.
- Advantageously, it is possible to detect an increased risk of legionella and to organise an action adapted for a controlled increase in the production temperature of the domestic hot water.

The temperature condition of the domestic hot water is determined so that the minimum value of the averages obtained is higher than or equal to a first predefined temperature threshold and the maximum value of the averages obtained is higher than a second predefined threshold, higher than the first threshold.

Advantageously, it is also possible to detect an increased risk of scaling and to implement a controlled reduction in the water production temperature.

The first temperature threshold is equal to 46° C. and the second temperature threshold is equal to 50° C.

Advantageously, the prevention of appearance of legionella and scale is balanced, and therefore optimised.

Another object of the invention is a unit for managing an installation for producing domestic hot water comprising electronic circuits configured for:

obtaining first information representing mean temperatures of the distributed hot water, determined by time ranges and measured by one or more divisional distribution meters during a reference period, obtaining a minimum value and a maximum value of the first information, determining a temperature condition of the distributed hot water from at least the maximum value of the temperature averages obtained or the minimum value of the temperature averages obtained, and from at least one predefined temperature threshold, and if the condition is met, sending a sequence controlling the distribution temperature to the production installation.

The invention furthermore relates to a water-distribution metering device, the meter comprising electronic circuits configured for:

sending, to a remote management unit, first information representing mean temperatures of the distributed water, determined by time ranges and measured by the meter itself or by other meters during a reference period, receiving a first control sequence from the management unit, in response to the first information, sending a second control sequence, representing the first control sequence, to a unit for producing hot water.

Another object of the invention is an installation for distributing domestic hot water, comprising an installation for producing hot water, and a unit for managing the production temperature of the hot water as previously described, and a divisional distribution metering device as described above.

Finally, an object of the invention is a computer program product comprising program code instructions for performing the steps of the aforementioned method, when the program is implemented by a processor, as well as an information storage medium device comprising such a computer program product.

BRIEF DESCRIPTION OF THE DRAWINGS

The features of the invention mentioned above, as well as others, will emerge more clearly from the reading of the following description of at least one example embodiment, said description being made in relation to the accompanying drawings, among which:

FIG. 2 illustrates an information table representing average water-temperature values measured and transmitted by one or more water-distribution meters of the installation already shown in FIG. 1, according to one embodiment;

DETAILED DISCLOSURE OF EMBODIMENTS

Figure 1:
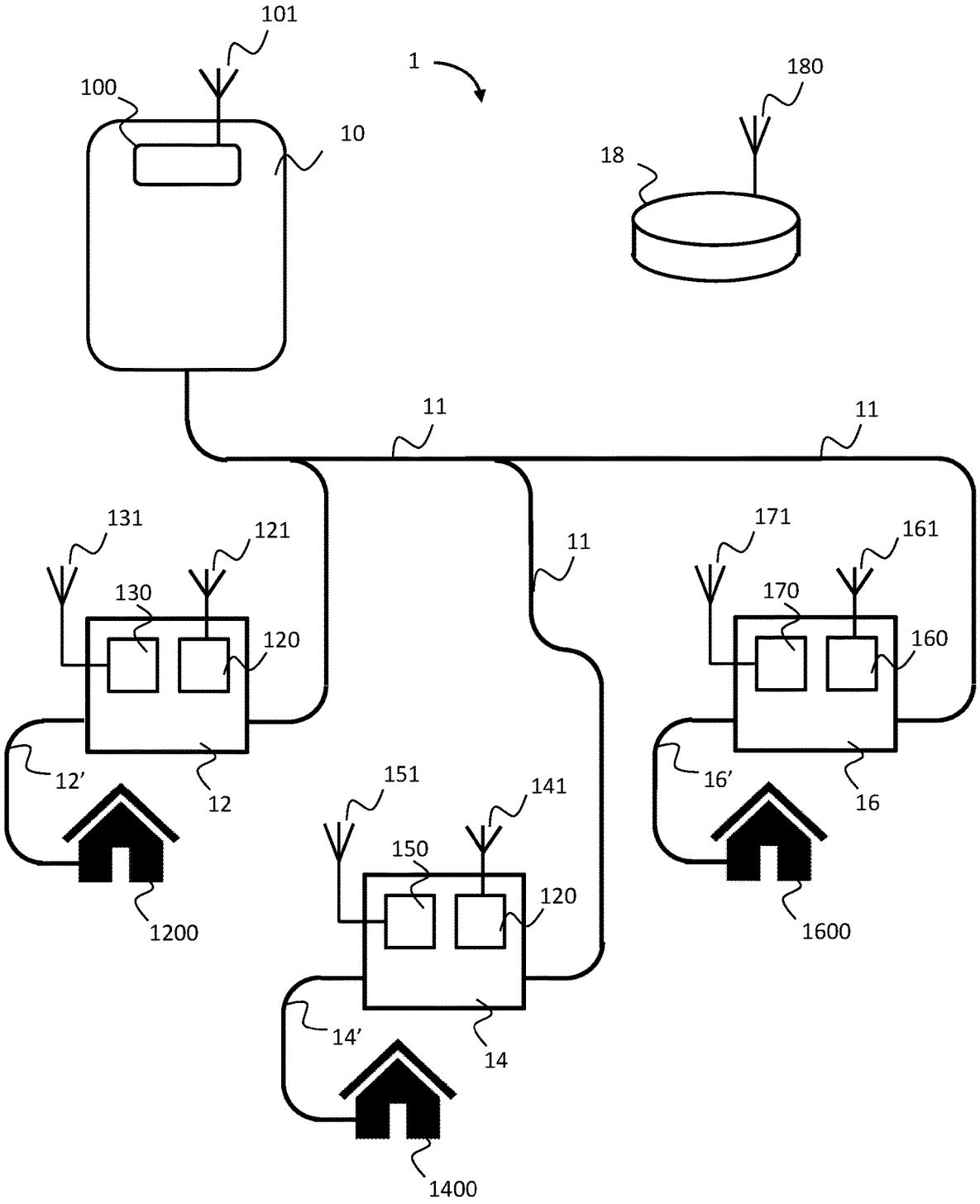
FIG. 1 illustrates schematically an installation for distributing domestic hot water from an installation for producing hot water to dwellings equipped with divisional distribution meters according to one embodiment of the invention.

FIG. 1 illustrates schematically a system 1 for distributing domestic hot water from an installation 10 for producing domestic hot water to a plurality of installations 1200, 1400 and 1600 for consuming domestic hot water. According to one embodiment, the installation 10 for producing domestic hot water is a boiler 10 comprising a boiler control unit 100 controllable remotely by means of a wireless communication interface 101, and the installations 1200, 1400 and 1600 for consuming domestic hot water are premises for dwelling use such as houses for example. The houses 1200, 1400 and 1600 are respectively provided with domestic hot water from the boiler 10 to divisional meters 12, 14 and 16 for distributing domestic hot water, through an installation 11 for distributing domestic hot water. Advantageously, the divisional distribution meters 12, 14 and 16 each comprise a unique identifier in the installation, with which they are respectively associated with a view to identification; this identifier being defined so that, the further away the meter is geographically from the boiler 10, the larger its identifier. Thus it is possible to refer quickly to the identifier of a divisional distribution meter to determine whether a distribution temperature of domestic hot water measured by this meter is supposed to be rather lower, rather higher or rather substantially equal to that measured by another divisional meter, further away from or closer to the boiler 10. The installation for distributing domestic hot water consists mainly of a distribution pipe 11 configured for conveying the domestic hot water from the boiler 10 to the houses 1200, 1400 and 1600, or more precisely to the divisional distribution meters 12, 14 and 16 of these houses. The boiler 10 conventionally comprises means for measuring the temperature of the domestic hot water at a plurality of points in a tank and in particular at the outlet of the boiler 10, not far from the connection with the distribution pipe 11. This temperature can be transmitted by the boiler to remote equipment. The meters 12, 14 and 16 for distributing domestic hot water are so-called "smart" consumption meters, in particular because of their abilities to make measurements and to locally process information resulting from these measurements, as well as to communicate with remote equipment, such as a remote control or management unit, a remote boiler provided with a remotely controllable boiler control unit, or a processing and instrumentation information system of the type commonly referred to as "IS", these examples not being limitative. In the present description, any device configured for measuring at least the consumption of a fluid supplied to an installation consuming this fluid, such as premises for dwelling use, for example, are referred to indifferently as "distribution meter" or "consumption meter", or "consumption-measuring meter" for a fluid, such as, for example, domestic hot water. The meters 12, 14 and 16 for distributing domestic hot water each comprise, apart from an internal control unit configured for making in particular measurements and controlling wireless communications, at least two communication interfaces. One of these interfaces of a distribution meter is configured for implementing wireless communications with other distribution meters, in particular adjacent ones, or with a boiler 10 producing domestic hot water. The other one of these interfaces of a distribution meter is configured for implementing in particular wireless communications with a unit 18 for managing the production of domestic hot water in the system 1 for distributing domestic hot water. The unit 18 for managing the production of domestic hot water in the distribution installation 1 is configured for implementing functions of controlling and supervising the installation 1 for distributing domestic hot water, in particular of controlling the production temperature of the water in the boiler 10 and more widely all the controls and operations usually implemented by a management system commonly described as an IS. The unit 18 for managing the production of domestic hot water comprises a wireless communication interface 180. Thus, for example, the management unit 18 is configured for making regular readings of consumption of volumes of domestic hot water, but also for updating software modules incorporated in each of the consumption meters 12, 14 and 16 and data useful for implementation of these software modules.

The purpose of all these wireless communications, on the one hand between the meters themselves, or between the meters and the boiler, and between the meters and the unit 18 managing production of domestic hot water on the other hand, is to participate in the overall control of the distribution installation, supervised by the management unit 18 implementing the IS functions.

Thus the meter 12 distributing domestic hot water comprises a first wireless communication interface 120 provided with an antenna system 121 and a second communication interface 130 provided with an antenna system 131; the meter 14 for distributing domestic hot water comprises a first wireless communication interface 140 provided with an antenna system 141 and a second communication interface 150 provided with an antenna system 151, and the meter 16 for distributing domestic hot water comprises a first wireless communication interface 160 provided with an antenna system 161 and a second communication interface 170 provided with an antenna system 171. The wireless communication interfaces 120, 140 and 160, respectively coupled with the antenna systems 121, 141 and 161, are configured for implementing wireless communications with the boiler 10, by means of the wireless communication interface 101 of the control unit 100 of the boiler 10. These interfaces are configured for implementing communication functions and protocols defined in accordance with one of the standards selected from: WM-Bus, BLE, Zigbee, or one of the respective upgrades thereof.

The wireless communication interfaces 130, 150 and 170, respectively coupled with the antenna systems 131, 151 and 171, are configured for implementing wireless communications with the management unit 18 of the IS type, by means of the wireless communication interface 180 of the management unit 18. These interfaces are configured for implementing communication functions and protocols defined in accordance with one of the standards selected from: WM-Bus, LoRA, NB-IoT, 4G, 5G or one of the respective upgrades thereof. According to one embodiment, each of the distribution meters 12, 14 and 16 is configured for being able to control the production temperature of the water in the boiler 10, from information received from the management unit 18. According to one variant, only a subset of the distribution meters 12, 14 and 16 comprises distribution meters configured for controlling the production temperature of the water in the boiler 10, for example a single distribution meter is configured for controlling the production temperature of the boiler 10, also commonly referred to as "boiler control". According to the example described, the divisional distribution meter 12 is dedicated to controlling the production temperature of the domestic hot water in the boiler 10 and therefore to controlling the latter. The meters 12, 14 and 16 for distributing domestic hot water are however configured for communicating with each other. Each of the meters contains a set of mechanical, electromechanical, electrical and electronic elements, including one or more temperature sensors, for measuring a consumption of domestic hot water and the temperature of the domestic hot water locally distributed over time. Each of the meters furthermore comprises timestamp means configured for time-stamping the measurements made with a precision of an order of one minute, or preferentially of the order of one second.

It should be noted that the meters 12, 14 and 16 are preferentially each disposed as close as possible to the house to which the hot water that it distributes is delivered, so as to be able to make a measurement that is most representative of the temperature of the water actually distributed in the house. Thus private pipes 12', 14' and 16', respectively arranged between the distribution meters 12, 14 and 16 and the houses 1200, 1400 and 1600, are the shortest possible in order to limit losses of heat in these pipes and therefore disparities between the water temperature measured in a distribution meter and the temperature of the water actually supplied to the various take-off points in the house connected to this meter (a washbasin, a sink, a shower or a bath, for example).

According to one embodiment, the meter 12 is configured for controlling the production temperature of the domestic hot water in the boiler 10, by sending sequences controlling the production-water temperature to the boiler. The purpose of a control sequence sent by the distribution meter 12 is to make one or more successive adjustments to the temperature of the domestic hot water available at the outlet of the boiler. A control sequence may comprise one or more control messages. For example, a control sequence may comprise a control message meaning "establish the production temperature of the water at 60°" or "establish the production temperature of the water at 46°". In the same way, a control message sent by the distribution meter 12 to the boiler 10 may mean "increase the production temperature of the domestic hot water by 14° C." or "reduce the temperature of the domestic hot water by 5° C.". Such a control sequence may also comprise a message containing one or more items of time information to be processed such as, by way of example, "wait 30 minutes", or "wait 45 minutes". Thus control messages can be sent sequentially by the divisional distribution meter 12 to the boiler 10 or in the form of a control sequence comprising a series of control messages some of which optionally comprise one or more items of time information. For example, a control sequence sent by the distribution meter 12 to the boiler may be: ["increase the hot-water production temperature by 14° C."; "wait 30 minutes"; "return to the initial temperature"; "wait 45 minutes"; "establish the production temperature of the water at 46° C."]. Another example of a control sequence sent by the distribution meter 12 to the boiler 10 could be, still by way of example ["establish the production temperature of the hot water at 60° C."; "wait 30 minutes"; "return to the initial temperature"]. According to one embodiment, the control messages, and therefore more broadly the control sequences between the distribution meter 12 and the boiler 10, are coded in the form of bytes to limit and simplify the communications. For example a byte "0x01" (in hexadecimal) of a control message may constitute a message header coding a control type to be applied, such as, by way of example, "temperature set-point", and a header byte "0x02" may signify "temperature set-point to be applied for 30 minutes". Thus control sequences can be very short. For example, a control sequence may contain only one control message limited to one or two bytes. The boiler 10 is configured for sending messages acknowledging reception of a control sequence that is sent to it. Thus, for example, the boiler 10 can send an acknowledgement message in the form of a single byte "0x01" serving as an acknowledgement of reception of a control sequence. Advantageously, in the event of significant disturbance, a control sequence seeking a complete restart of the boiler and of its various elements, in particular its internal control unit 100, may be sought by the distribution meter 12.

The internal control unit 100 of the boiler 10 comprises means for processing messages coming from one or more distribution meters, in particular means for electing a distribution meter as external programming device for the boiler, means for storing control messages or sequences received and for processing in a coherent order, as well as means for sending an error or alert message in the event of a malfunctioning noted.

Advantageously, the boiler 10 regularly transmits to the meter 12 the temperature of the heated domestic hot water measured at the outlet of the boiler, and the distribution meter 12 transmits this temperature to the measurement unit 18 implementing IS functions.

According to one embodiment of the invention, each of the distribution meters 12, 14 and 16 transmits at regular intervals to the unit 18 for managing the temperature of the distributed water measured in the meter. According to a variant, the meters record temperature measurements and then transmit them in batches to the unit 18 for managing the hot-water production temperature in the boiler 10. According to another variant, the meters 14 and 16 regularly transmit measured temperatures to the distribution meter 12, which next transmits them, regularly or in batches, to the management unit 18. Whatever the implementation selected for the transmission of the temperature measurements made by the distribution meters to the management unit 18, the temperature measurements are time-stamped, so that the management unit 18 obtains first information representing mean temperatures of the domestic hot water distributed from the boiler 10, determined by time ranges of a predefined duration and measured by the distribution meters 12, 14 and 16 in the course of a reference period. The example described comprises the three meters 12, 14 and 16 for distributing domestic hot water, but it should be noted that the system for controlling the production of hot water is configured for operating even if only one hot-water meter is operational in the system. According to one embodiment, the reference period is a few days, and preferentially the reference period is equal to one day, considered as from a predefined time, until the same time on the following day. Advantageously, the predefined time ranges have a duration equal to 3 hours without however this choice being limitative. Thus the management unit may have available first information on temperature averages measured by the divisional distribution meters 12, 14 and 16, by time ranges, as shown on FIG. 2. The lines in the table in FIG. 2 comprise mean temperature values measured by time ranges T1 to T8. The columns in the table shown therefore correspond to the time ranges T1 to T8 following each other in the course of the reference period T, i.e. one day according to the example described. The temperatures are indicated in ° C. and it can therefore be noted that, according to the example described, for the reference period that made it possible to measure the values shown, the minimum mean temperature θmin measured by a distribution meter is equal to 40° C. and maximum mean temperature θmax measured by a distribution meter is equal to 51° C.

This information representing mean temperatures of the hot water produced and then distributed in the houses 1200, 1400 and 1600 is determined by time ranges for time ranges T1, T2, T3, T4, T5, T6, T7 and T8 with a duration of 3 hours each and succeeding each other over a reference period of one day. Thus, for example, T1 extends from 0 hours to 3 a.m.; T2 extends from 3 a.m. to 6 a.m.; T3 extends from 6 a.m. to 9 a.m. and so on until T8, which extends from 9 p.m. to midnight (or 0 hours on the next day), all these time ranges following each other over the reference period T defined from 0 hours to midnight. The management unit 18 having available these values is then able to determine a minimum value θmin of the mean temperatures received and a maximum value θmax of these same mean temperatures, for example by means of a simple operation of sorting each occurrence of the mean values. The management unit 18 can thus advantageously then establish one or more conditions of distribution of the domestic hot water that has a particular advantage in terms of detection, from at least one of these θmin and θmax values and from at least one significant predefined temperature threshold. For example, the management unit 18 can analyse the situation from θmin and/or θmax values with regard to one or more predetermined threshold values that are meaningful in terms of prevention against health and/or technical risks. By way of example, a minimum value of distributed water below a temperature of 46° C. gives rise to a risk of legionnaire's disease for the occupants of a house in which the meter has measured this temperature of distributed hot water. Still by way of example, a maximum value above 50° C. gives rise to an increased risk of scaling of the installation in the house in which the meter has measured this temperature of distributed hot water. Thus it can be advantageous to define a temperature threshold L1 at 46° C., for example, or a threshold L2 at 50° C., or at temperatures close to these values, for example in a range of values between 45° C. and 51° C.

Establishing a condition then advantageously makes it possible to analyse the situation with regard to a precise criterion, such as the risk of legionnaire's disease or the risk of significant scaling. A condition may furthermore aim to simply check that there exists neither a risk of legionnaire's disease nor even an increased risk of scaling, for example by establishing a condition that comprises the terms θmin, θmax, and thresholds L1 and L2 respectively defined at 46° C. and 50° C. Such a condition may be:

$$\theta min >= L1 \text{ and } \theta max <= L2, \text{ where } L1 \text{ is predefined at } 46^\circ \text{ C. and } L2 \text{ is predefined at } 50^\circ \text{ C.}$$

This condition, when it is met (in other words satisfied or fulfilled) can be expressed literally by "the minimum of the temperatures of hot water actually distributed is higher than a threshold temperature as from which the proliferation of legionella is limited, and the maximum of the temperatures of hot water actually distributed is below the threshold temperature as from which a risk of increased scaling is substantial". It is thus possible to deduce therefrom a satisfactory distribution situation.

Figure 3:
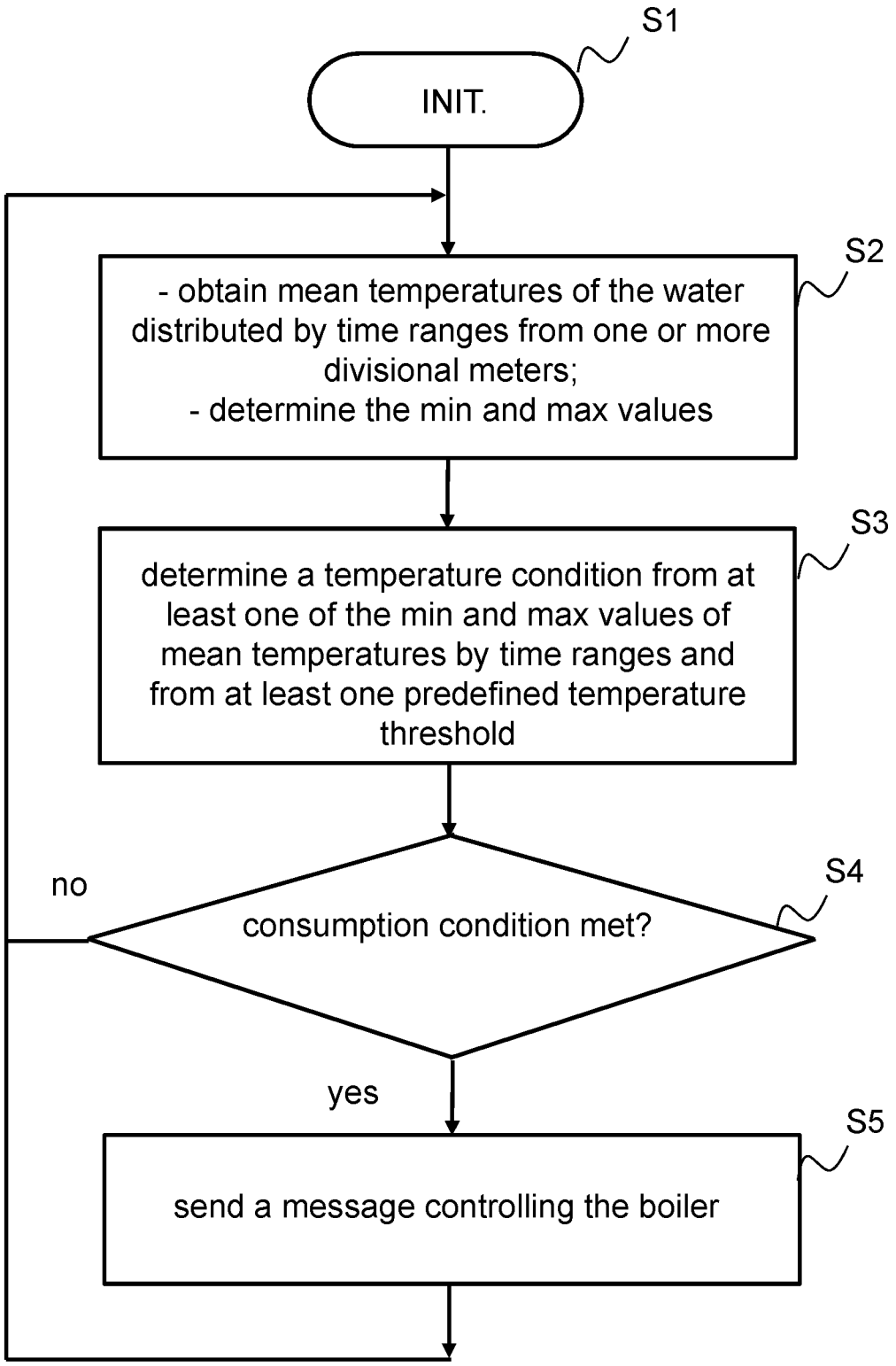
FIG. 3 is a flow diagram representing a method for controlling the production temperature of domestic hot water in an installation already shown on FIG. 1, according to one embodiment.

FIG. 3 illustrates a method for controlling the production temperature according to one embodiment of the invention. In the present description, a control of the production temperature and a control of the distribution temperature are considered indifferently since, advantageously and by virtue of the measurements made according to the method, controlling the production temperature affords control of the distribution temperature. It is moreover advantageously possible to measure the time of increase of the temperature in a meter from the time of increase of the set point of the production temperature in the boiler, which makes it possible to obtain an at least approximate knowledge of the technical state of the system. A step S1 is a step of initialisation or commissioning of the installation 1 for distributing domestic hot water at the end of which all the devices in the installation 1 are normally operational and able to interact with each other. In particular, the smart divisional meters 12, 14 and 16 for distributing water are operational, the management unit 18 provided for controlling the production temperature of the water is operational and the boiler is operational and contains hot water at a temperature of several tens of ° C.

In a step S2, the distribution meters 12, 14 and 18 each make local time-stamped measurements of the temperature of the distributed water and record them in an internal memory, by time ranges of 3 hours, throughout a reference period of one day, and then each determine mean values by time ranges and transmit these mean temperatures by time ranges to the remote management unit 18. This transmission is done either directly to the remote management unit 18, or by means of one of the meters dedicated to this purpose. Thus, in this step S2, the management unit 18, which implements the method, obtains the mean temperature values, determined by time ranges during the reference period of one day, and then determines which is the lowest of these measured temperature averages, θmin, and which is the highest of these measured temperature averages, θmax. In a step S3, the management unit 18 determines, from at least one of these minimum values θmin and maximum values θmax, a condition representing a situation of interest in terms of prevention for the installation 1 distributing domestic hot water. For example, a condition of faulty operation of the heating element can be established and expressed by:

$$\theta max<(L1=40^\circ\ C.)$$

This means, if the condition thus determined is fulfilled, that the domestic hot water has an excessively low temperature with regard to usual domestic use.

The condition predetermined in the step S3 is then tested (or checked) in a step S4, so that, if the condition is met, a control sequence is then sent in a step S5 from the management unit 18, to the boiler 10, by means of the distribution meter 12, which is configured to control the boiler 10 from the management unit 18. In other words, the distribution meter 12 performs functions of relay between the management unit 18 and the boiler 10. This control sequence is for example: [increase the production temperature to 46° C.; regulate the production temperature at 47° C.+/−1° C.].

Figure 4:
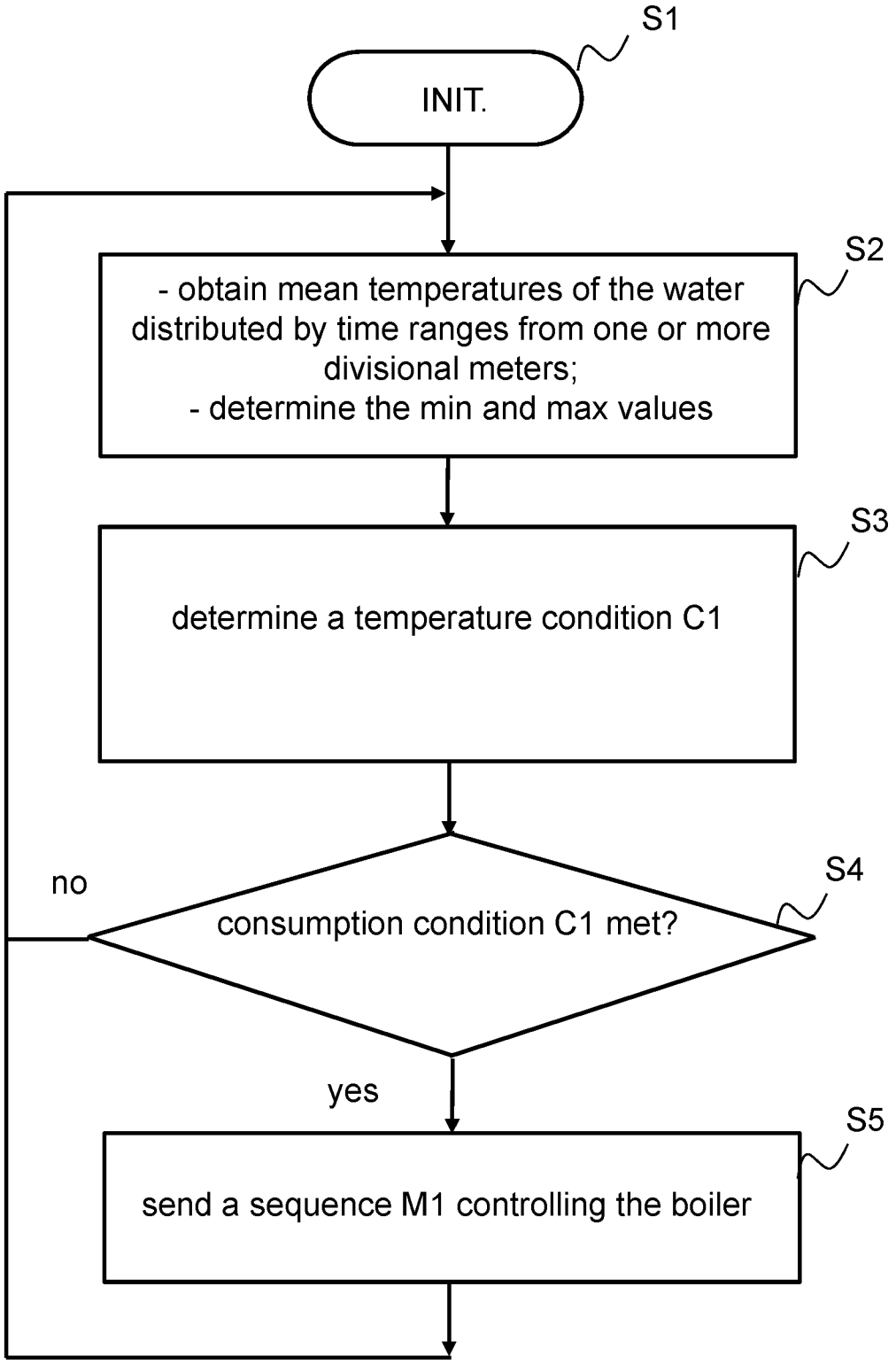
FIG. 4 is a flow diagram representing a first variant of the embodiment of the method already shown on FIG. 3.

FIG. 4 shows a method for controlling the distribution of the water in the distribution installation 1, similar to the one already described in relation to FIG. 3, and wherein a condition of good distribution of the hot water is determined to check that the distribution is optimal with regard to the risks of legionnaire's disease and scaling. The steps S1 and S2 are similar to those of the method already described in relation to FIG. 3.

At the step S3 the condition C1 is determined:

$$\theta min>=(L1=46^\circ\ C.)\ and\ (\theta max<=(L2=50^\circ\ C.))$$

The condition C1 is then tested at the step S4 so that, if the condition is met, a control sequence M1 is sent to the boiler 10, in a step S5, by means of the distribution meter 12. The control sequence M1 is then thus determined:

M1: [increase the production temperature by (60° C.−θmin) for 30 minutes; return to the initial temperature].

Figure 5:
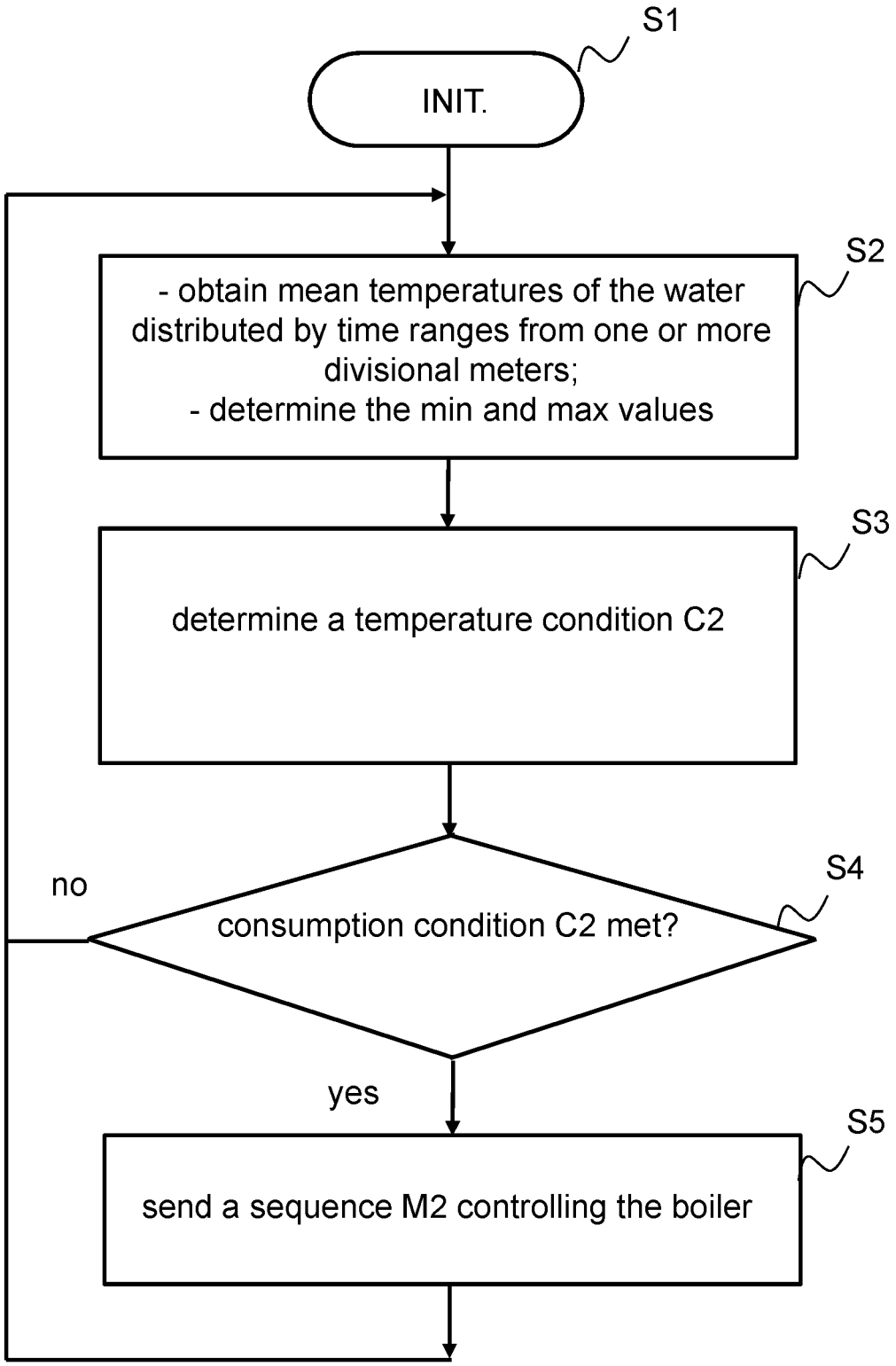
FIG. 5 is a flow diagram showing a second variant of the embodiment of the method already shown on FIG. 3.

FIG. 5 shows a method for controlling the distribution of the water similar to the one already shown in relation to FIG. 3, wherein a condition of unfavourable distribution with regard to the risks of legionnaire's disease is determined at the step S3 and tested at the step S4. The steps S1 and S2 are similar to those of the method already described in relation to FIG. 3.

At the step S3 the condition C2 is determined:

$$\theta min<(L1=46^\circ\ C.)$$

The condition C2 is then tested at the step S4 so that, if the condition is met, a control sequence M2 is sent to the boiler 10, in a step S5, by means of the distribution meter 12. The control sequence M2 is then thus determined:

M2: [increase the production temperature by (60° C.−θmin) for 30 minutes; return to the initial temperature; wait for 45 minutes, increase the production temperature by (46° C.−θmin)].

Figure 6:
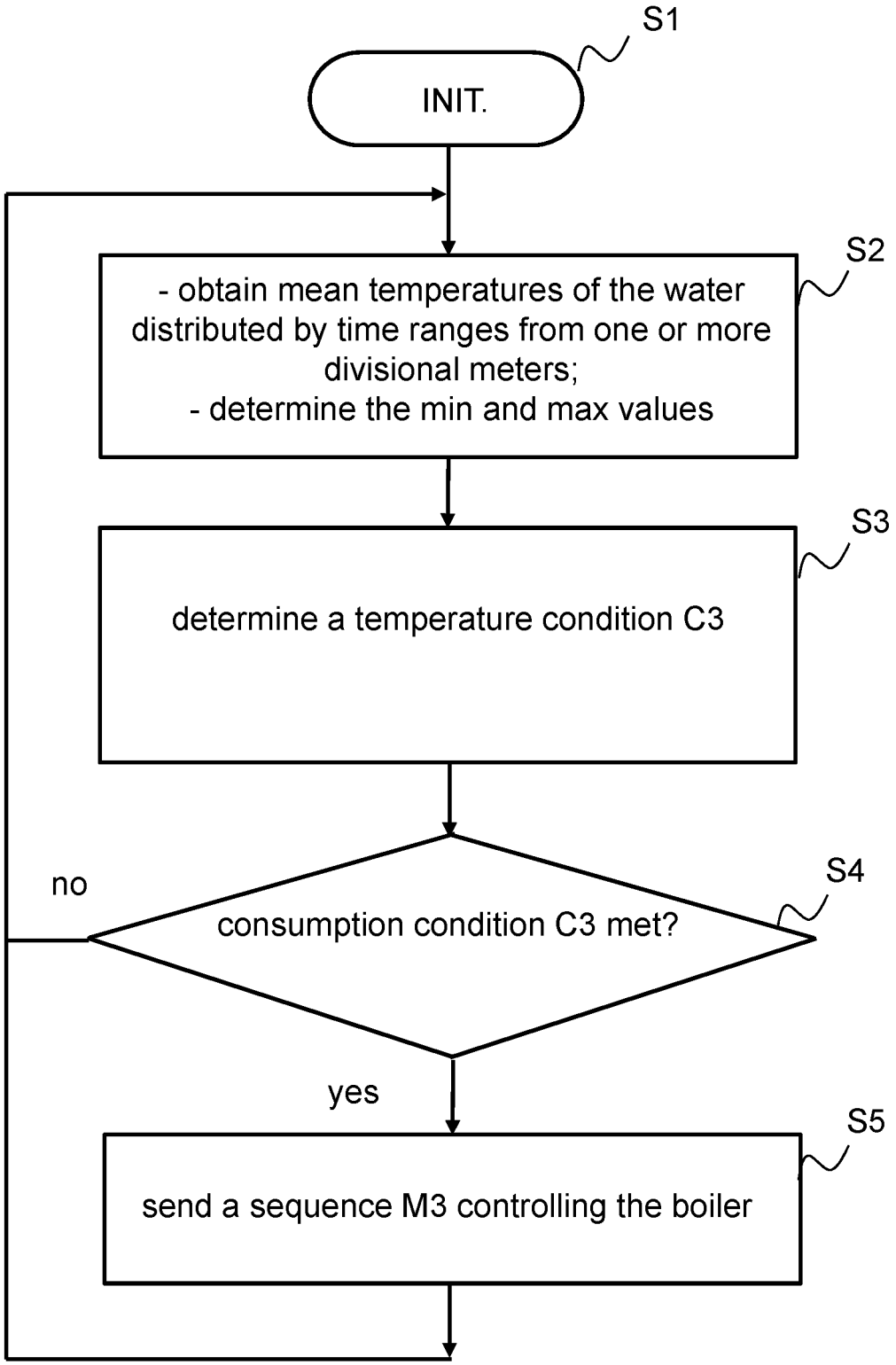
FIG. 6 is a flow diagram showing a third variant of the embodiment of the method already shown on FIG. 3; and, FIG. 7 is a diagram showing the architecture of a unit for managing a production temperature of domestic hot water configured for implementing a method described in one of FIG. 3, FIG. 4, FIG. 5 and FIG. 6.

FIG. 6 shows a method for controlling the distribution of the water similar to the one already described in relation to FIG. 3, wherein a distribution condition that is unfavourable with regard to increased risks of scaling is determined at the step S3 and tested at the step S4. The steps S1 and S2 are similar to those of the method already described in relation to FIG. 3.

At the step S3 the condition C3 is determined:

$$(\theta min>=(L1=46^\circ\ C.))\ and\ (\theta max>(L2=50^\circ\ C.))$$

The condition C3 is then tested at the step S4 so that, if the condition is met, a control sequence M3 is sent to the boiler 10, in a step S5, by means of the distribution meter 12. The control sequence M3 is then thus determined:

M3: [increase the production temperature by (60° C.−θmin) for 30 minutes; return to the initial temperature; wait for 45 minutes; reduce the reduction temperature by (θmin−46° C.)].

According to a particular embodiment of the invention, a method for controlling the production temperature of the domestic hot water in the distribution installation 1 may comprise several series of steps S3, S4, S5 aimed at successively testing several water-distribution conditions, and at performing corrective actions in a sequenced fashion according to the test results for each condition tested, where applicable. For example, a method may comprise first of all steps S3, S4 as described in relation to FIG. 4 and, if the condition C1 is met, then the step S5 of the method described in relation to FIG. 4 is performed, otherwise the method performs the steps S3 and S4 of the method described in relation to FIG. 5, and then, if the condition C2 is met, the step S5 of the method described in relation to FIG. 5 is performed, and otherwise the steps S3 and S4 in relation to the method described in relation to FIG. 5 are performed, and optionally that of the step S5 of the same method described in relation to FIG. 6. Thus the three conditions C1, C2 and C3 are each potentially implemented during the implementation of such a method. It should be noted that this sequencing makes it possible to establish a treatment priority against the risks of legionnaire's disease compared with treatment against increased risks of scaling. Advantageously, each of the methods respectively described in relation to FIG. 4, FIG. 5 and FIG. 6 is implemented at least once per reference period, i.e. in this case daily, in order better to prevent the risks of legionnaire's disease and scaling.

According to one embodiment, it is possible to detect that a dwelling is unoccupied for a prolonged period, when the hot-water consumption detected by a divisional distribution meter 12, 14, 16 associated with said dwelling is below a predefined consumption threshold during a period of a first predefined duration. The predefined consumption threshold is for example 30 L, preferentially 20 L or more preferentially 10 L, and the period of first predefined duration is for example seven days or according to another example 2 to 4 weeks. It is furthermore possible to detect that an unoccupied dwelling is once again occupied as soon as the consumption of hot water detected by the divisional distribution meter 12, 14, 16 associated with said dwelling exceeds the predefined consumption threshold over an interval of time of less than a second predefined duration. For example, an unoccupied dwelling for which a consumption of water exceeds 10 L over an interval of one hour is once again considered to be occupied. As soon as an unoccupied dwelling is detected as being once again occupied, the minimum mean temperature value θmin and maximum mean temperature value θmax are forced to respective values equal to the temperature thresholds L1 and L2 defined for example respectively at 46° C. and 50° C. Thus, when the management unit 18 tests the consumption conditions C1, C2, C3 at the step S4, the condition C1 is automatically met, which gives rise, at the step S5, to the sending of a control sequence M1 associated with the condition C1. In other words the management unit sends the control sequence M1 causing the increase in the production temperature of (60° C.−θmin) for 30 minutes before a return to the initial temperature, so as to eliminate any legionella that might have developed while the dwelling was unoccupied. Thus the invention makes it possible, when occupation of a dwelling is detected after a prolonged absence in said dwelling, to eliminate any legionella by forcing the sending of a predetermined sequence of controlling the distribution temperature to the boiler 10 by means of the distribution meter 12, 14, 16 associated with said dwelling.

Advantageously, if the management unit 18 obtains first values representing distributed-water temperature averages, distributed by time ranges that appear to be incoherent, it can seek an instantaneous measurement, from all the divisional distribution meters 12, 14 and 16 of the distribution installation 1 and implement an appropriate method on this information, then being valid as first information within the meaning of the method as previously described. Advantageously, if temperature information cannot be obtained for one or more reference periods, successive or not, this information is then replaced by the last temperature information obtained coming from this meter. Furthermore, if a meter has not been able to deliver temperature information during a number of reference periods exceeding a predetermined threshold, such as for example one week, the information coming from the distribution meter closest to the meter presumed to be defective is used.

Figure 7:
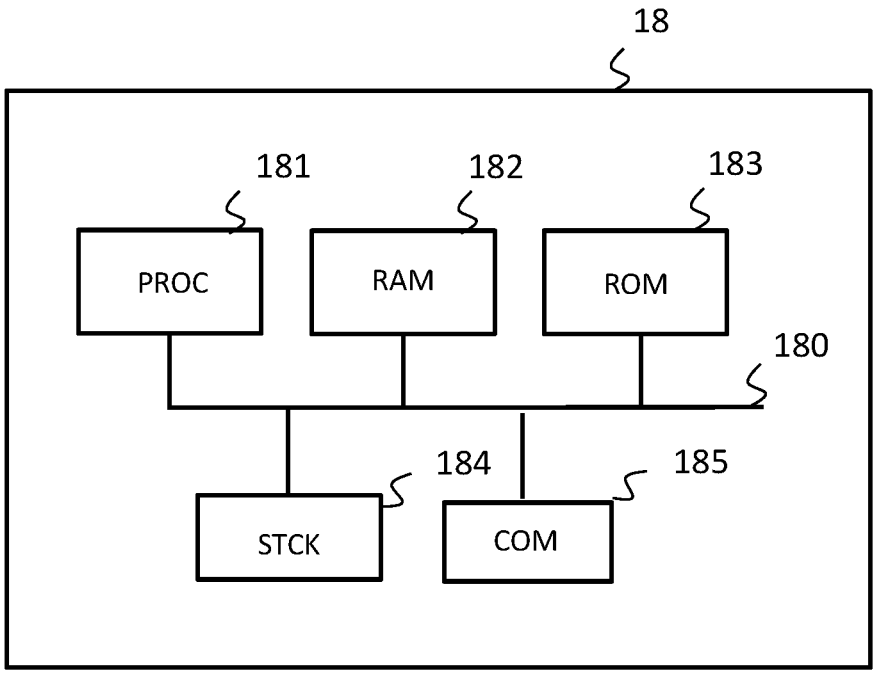

FIG. 7 illustrates schematically an example of internal architecture of the management unit 18 supervising the production, and therefore the distribution, of domestic hot water in the boiler 10. The architecture shown may also represent the internal architecture of a divisional distribution meter among the distribution meters 12, 14 and 16 or the architecture of the control unit 100 of the boiler 10.

According to the example of hardware architecture shown in FIG. 7, the management unit 18 controlling production of domestic hot water then comprises, connected by a communication bus 186: a processor or CPU (central processing unit) 181; a random access memory RAM 182; a read only memory ROM 183; a storage unit such as a hard disk (or a storage medium reader, such as an SD (Secure Digital) card reader 184; at least one communication interface 180 enabling the management unit 18 to communicate with remote devices such as the distribution meters 12, 14 and 16 or the boiler 10, by means of its internal control unit 100.

The processor 181 is capable of executing instructions loaded in the RAM 182 from the ROM 183, from an external memory (not shown), from a storage medium (such as an SD card), or from a communication network. When the management unit 18 is powered up, the processor 181 is capable of reading instructions from the RAM 182 and implementing them. These instructions form a computer program causing the implementation, by the processor 181, of a part of a method described in relation to FIG. 3, FIG. 4, FIG. 5 and FIG. 6.

All or part of the method implemented by the management unit 18, or variants thereof described, can be implemented in software form by executing a set of instructions by a programmable machine, for example a DSP (digital signal processor) or a microcontroller, or be implemented in hardware form by a machine or a dedicated component, for example an FPGA (field-programmable gate array) or an ASIC (application-specific integrated circuit). In general, the management unit 18 comprises electronic circuitry configured for implementing the method described in relation to itself as well as to remote third-party equipment, and with any other device involved in the implementation of the method for controlling the production temperature of domestic hot water described. Obviously, the management unit 18 further comprises all the elements usually present in a system comprising a control unit and the peripherals thereof, such as a power supply circuit, a power-supply monitoring circuit, one or more clock circuits, a reset circuit, input-output ports, interrupt inputs, bus drivers. This list being non-exhaustive.

The invention is not limited solely to the embodiments described but relates more broadly to any method for controlling a production and distribution temperature of domestic hot water comprising steps for: obtaining mean temperatures of distributed hot water, determined by time ranges and measured by one or more divisional distribution meters during a reference period; determining minimum and maximum values of these means observed over the reference period and determining, from at least one of these values, and from at least one significant temperature threshold, one or more water-distribution conditions so that, if the condition established is met, a sequence for controlling the production temperature of the water is sent to the production installation, directly or by means of relay equipment such as a divisional meter.

The invention claimed is:

1. A method for controlling a distribution temperature of domestic hot water, the method being implemented in a unit comprising electronic circuitry configured for managing a remotely controllable boiler control unit of an installation for producing said domestic hot water, and comprising:

obtaining first items of information representing mean temperatures of the distributed hot water, respectively determined by time ranges, and measured by one or more divisional distribution meters during a reference period, obtaining a minimum value and a maximum value among said first items of information, determining a temperature condition of the distributed hot water with respect to at least one value among said maximum value and said minimum value, and from at least one predefined temperature threshold, and, sending a control sequence comprising one or more control messages configured for controlling said boiler so as to control said distribution temperature of the production installation in response to said condition being met.

2. The method for controlling a distribution temperature of domestic hot water according to claim 1, wherein the at least one predefined temperature threshold is between 45° C. and 51° C. or equal to 45° C. or 51° C.

3. The method for controlling a distribution temperature of domestic hot water according to claim 1, wherein the control sequence is sent to the production installation via one of the water-distribution meters.

4. Method for controlling a distribution temperature of domestic hot water according to claim 1, wherein the temperature condition of the domestic hot water is determined so that the minimum value is higher than or equal to a first predefined temperature threshold and the maximum value is lower than or equal to a second predefined temperature threshold, higher than the first threshold.

5. The method for controlling a distribution temperature of domestic hot water according to claim 4, each divisional distribution meter being associated with a dwelling, the method comprising:

detecting that a dwelling is unoccupied when a consumption of hot water measured by a divisional distribution meter associated with the dwelling is below a predefined consumption threshold over a period of first predefined duration, detecting that an unoccupied dwelling is once again occupied when the consumption of hot water measured by a divisional distribution meter associated with the dwelling exceeds the predefined consumption threshold over a period of second predefined duration, forcing the minimum mean temperature value to a value equal to the first predefined temperature threshold, and forcing the maximum mean temperature value to a value equal to the second predefined temperature threshold, for each divisional distribution meter the dwelling of which has previously been detected as unoccupied and detected as once again occupied.

6. The method for controlling a distribution temperature of domestic hot water according to claim 1, wherein the temperature condition of the domestic hot water is determined so that the minimum value is lower than a first predefined temperature threshold.

7. The method for controlling a distribution temperature of domestic hot water according to claim 1, wherein the temperature condition of the domestic hot water is determined so that the minimum value is higher than or equal to a first predefined temperature threshold and the maximum value is higher than a second predefined threshold, higher than the first threshold.

8. The method for controlling a distribution temperature of domestic hot water according to claim 4, wherein the first temperature threshold is equal to 46° C. and the second temperature threshold is equal to 50° C.

9. A non-transitory information storage medium storing a computer program product that comprises program code instructions for implementing the steps of the method according to claim 1, when the computer program product is implemented by a processor.

10. The method for controlling a distribution temperature of domestic hot water according to claim 1, wherein the at least one predefined temperature threshold is between or equal to 46° C. and 50° C.

11. A unit for managing a remotely controllable boiler control unit of an installation—for producing domestic hot water, the unit for managing comprising electronic circuits configured for:

obtaining—first items of information representing mean temperatures of the distributed hot water, respectively determined by time ranges and measured by one or more divisional distribution meters during a reference period, obtaining—a minimum value and a maximum value among said first items of information, determining—a temperature condition of the distributed hot water with respect to at least one value among said maximum value and said minimum value, and from at least one predefined temperature threshold, and sending a control sequence comprising one or more control messages configured for controlling said boiler so as to control said distribution temperature of the production installation in response to said condition being met.

12. A water-distribution metering device, the meter comprising electronic circuits configured for:

sending, to a remote management unit, first items of information representing mean temperatures of distributed water, respectively determined by time ranges and measured by the meter itself or by other meters during a reference period, receiving a first control sequence from the management unit, in response to the first items of information, sending a second control sequence, representing the first control sequence, to a hot-water production unit for controlling a boiler to control a distribution temperature of a production installation in response to a temperature condition being met, wherein the temperature condition of the distributed water is determined with respect to at least one value among a maximum value and a minimum value among the first items of information, and from at least one predefined temperature threshold.

13. An installation for distributing domestic hot water, comprising an installation for producing hot water, a management unit according to claim 11, and a distribution meter device comprising electronic circuits configured for:

sending, to a remote management unit, first information representing mean temperatures of the distributed water, determined by time ranges and measured by the meter itself or by other meters during a reference period, receiving a first control sequence from the management unit, in response to the first information, sending a second control sequence, representing the first control sequence, to a hot-water production unit.

* * * * *